United States Patent [19]

Muller et al.

[11] 4,454,715

[45] Jun. 19, 1984

[54] FLUID CONTROL SYSTEM

[75] Inventors: Thomas P. Muller, Montgomery; Leon A. Wirt, Joliet, both of Ill.

[73] Assignee: Caterpillar Tractor Co., Peoria, Ill.

[21] Appl. No.: 278,493

[22] PCT Filed: May 22, 1981

[86] PCT No.: PCT/US81/00689

§ 371 Date: May 22, 1981

§ 102(e) Date: May 22, 1981

[87] PCT Pub. No.: WO82/04105

PCT Pub. Date: Nov. 25, 1982

[51] Int. Cl.[3] ..... F15B 13/06; F15B 13/09

[52] U.S. Cl. ..... 60/421; 60/426; 91/32; 91/33; 91/517

[58] Field of Search ..... 91/516, 517, 518, 28, 91/32, 33, 514, 532, 29; 60/420, 421, 426, 484, 486, 422, 427, 428, 429, 430

[56] References Cited

U.S. PATENT DOCUMENTS

| | | | |
|---|---|---|---|
| 3,065,739 | 11/1962 | Boroson | 91/32 |
| 3,584,537 | 6/1971 | Schulz | 91/517 |
| 3,978,998 | 9/1976 | Klitz | 91/516 |
| 4,024,797 | 5/1977 | Johnson | 91/514 |
| 4,070,857 | 1/1978 | Wible | 91/516 |
| 4,078,681 | 3/1978 | Field, Jr. | 60/421 |
| 4,083,291 | 4/1978 | Larsson | 91/517 |
| 4,142,445 | 3/1979 | Lohbauer | 91/6 |
| 4,343,151 | 8/1982 | Lorimor | 91/33 |

*Primary Examiner*—Robert E. Garrett
*Assistant Examiner*—Richard L. Klein
*Attorney, Agent, or Firm*—Claude F. White

[57] ABSTRACT

A fluid control system (10) has a first fluid pump (12) for supplying pressurized fluid in interrupted series to first and second work elements (14,16). The first work element (14) in the series has priority which prevents simultaneous full power operation of the first and second work elements (14,16). A second fluid pump (24) is capable of supplying pressurized fluid to the second work element (16) only upon receiving a signal indicating that pressurized fluid from the first pump (12) is being directed to the first work element (14). The subject fluid control system (10) is especially useful with a tree harvesting machine where it is beneficial to propel the machine and at the same time rotate the upper structure.

5 Claims, 1 Drawing Figure

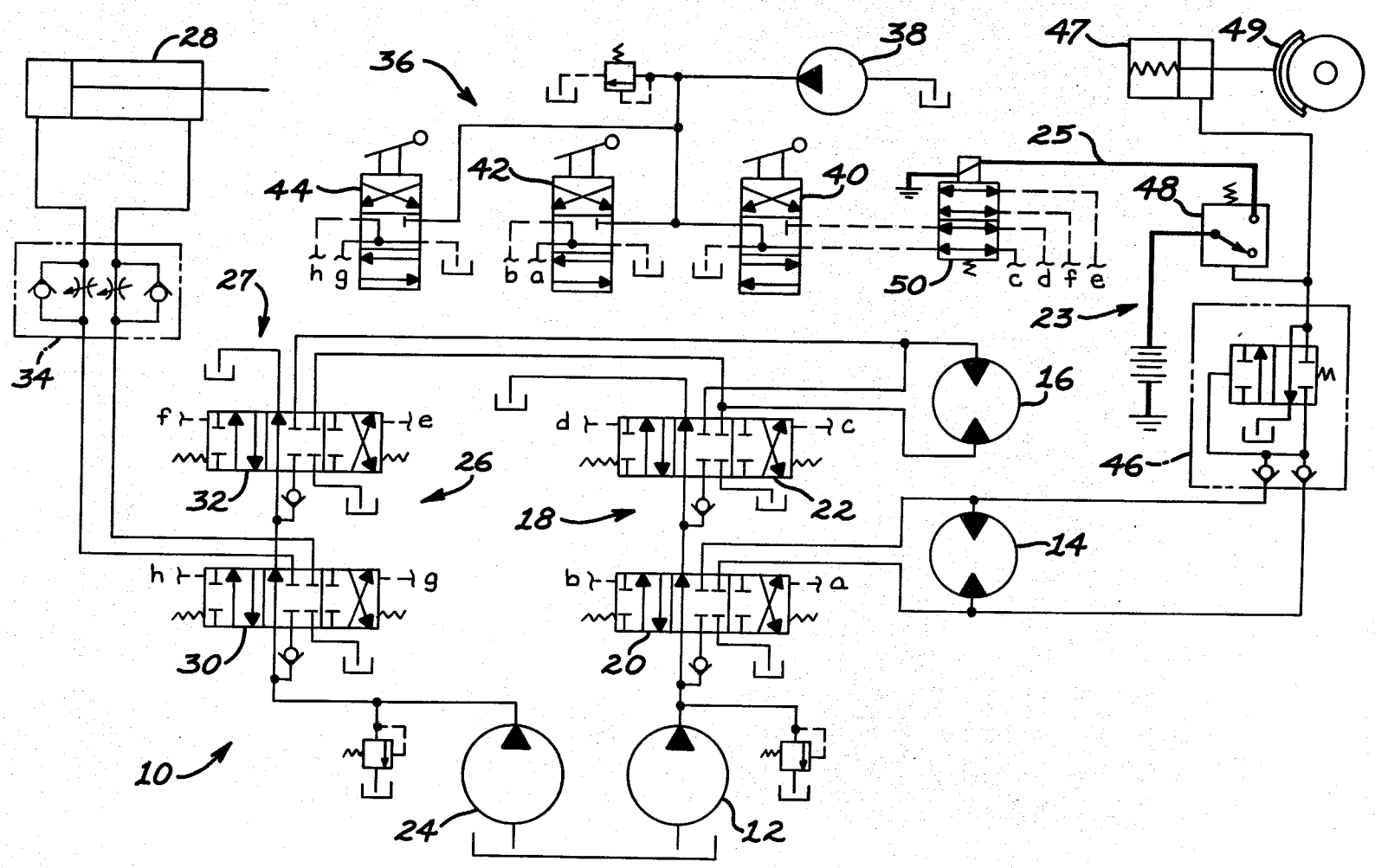
10
12
14
16
18
20
22
23
24
25
26
27
28
30
32
34
36
38
40
42
44
46
47
48
49
50

FLUID CONTROL SYSTEM

DESCRIPTION

1. Technical Field

This invention relates generally to fluid control systems and more particularly to a system which selectively, controllably supplies pressurized fluid to several work elements. Two separate fluid sources within the fluid control system each controllably, selectively supply pressurized fluid to a preselected single work element under preselected conditions of operation.

2. Background Art

In fluid control systems having a plurality of work elements, it is common practice to provide the work elements with pressurized fluid from a single fluid source by interconnecting the control valves of the work elements in an interrupted series circuit. Certain ones of the work elements therefore have priority over the other work elements. In such a system, the work elements having less priority are generally not operational when the work elements having the greater priority are functionally operational. In certain fluid control systems using interrupted series circuits, the work elements having less priority may be partially operational by modulation of the control valves which control the higher priority work elements. However, such systems are generally inefficient and require difficult manipulation of the fluid controls by the operator.

It is often desirable to operate several work elements of a work vehicle simultaneously in order to save time and energy and make a work operation more efficient. To this end, the several work elements can be provided with separate fluid circuits having individual pumps and controls. However, this increases the costs of the fluid control system, adds weight and bulk to the overall machine, and represents waste.

The present invention is directed to overcoming one or more of the problems as set forth above.

DISCLOSURE OF THE INVENTION

In one aspect of the present invention, a fluid control system has a first source of pressurized fluid, first and second work elements, and a first control means for delivering pressurized fluid to the first and second work elements. The fluid control system also has a means which transmits a signal only in response to pressurized fluid being delivered to the first work element. A second source of pressurized fluid is deliverable to the second work element under preselected conditions.

Prior fluid control systems utilized an interrupted series circuit to supply pressurized fluid from a single pump on a priority basis to several work elements. However, a lesser priority work element could not be operated, or could be operated at less than full power, when a higher priority work element was being used. In many instances, it would be advantageous to operate at least two work implements of the priority system simultaneously and at full power. The subject invention provides a solution to these problems by making a second pump available to a lesser prior work element only when fluid from a first pump is being utilized to operate a higher priority work element.

BRIEF DESCRIPTION OF THE DRAWING

The drawing is a diagrammatic view of an embodiment of the present invention.

BEST MODE FOR CARRYING OUT THE INVENTION

Referring to the drawing, a fluid control system 10 has a first source of pressurized fluid 12, first and second work elements 14,16, and a first control means 18 for controllably delivering pressurized fluid to one of the first and second work elements 14,16. Work element 14 is preferably a fluid motor, such as a track motor, for driving the tracks of a track-type machine, such as a tree harvester (not shown). Work element 16 is preferably a fluid motor such as a swing motor for rotating the upper portion of a tree harvester (not shown). The first control means 18 has first and second control valves 20 and 22 for controllably delivering pressurized fluid from the pump 12 to the work elements 14 and 16. Valves 20 and 22 are arranged in interrupted series which provides that work element 14 has priority over work element 16. Therefore, work element 16 cannot normally be operated when work element 14 is functioning. However, simultaneous reduced speed operation of work element 16 is possible if all of the pressurized fluid is not being used by work element 14 and the control valve 20 can be modulated.

The fluid control system 10 includes a first means 23 for transmitting a signal 25 only in response to pressurized fluid being delivered to the first work element 14. The control system 10 has a third work element 28, a second source of pressurized fluid, including a pump 24, and a second means 27 for delivering pressurized fluid from the second fluid source 24 to the second work element 16 only in response to receiving the signal 25. The second means 27 includes a second control means 26.

The second control means 26 has third and fourth control valves 30 and 32 which controllably deliver pressurized fluid from the second source 24 to the work element 28 and the work element 16, as will be hereinafter more fully explained. Control valves 30,32 are also arranged in interrupted series. The control means 26 includes a flow control valve 34 which limits the maximum amount of pressurized fluid being directed from the second source 24 to the third work element 28. This assures that a controlled portion of the total amount of the pressurized fluid from the second source 24 is simultaneously deliverable to the second and third work elements 16,28.

The first means 23 for transmitting the signal 25 includes a pressure actuated travel alarm switch 48 and a selector valve 50, which is activated by the switch 48.

The fluid control system 10 has a pilot actuating system 36 having a plurality of pilot actuating valves 40,42,44 for actuation of the control valves 20,22,30,32, and a third source of fluid pressure 38. For clarity, the connecting lines between the pilot actuating valves 40,42,44 and the associated control valves 20,22,30,32 have been broken. In the drawing, line ends with common letters are in fluid communication with each other.

A brake valve 46 and the travel alarm switch 48 are in fluid communication with the track motor 14. When the track motor 14 is activated, the brake valve 46 is shifted to pressurize cylinder 47 which releases the track brakes 49, and at the same time activates the travel alarm switch 48 and its associated alarm. Actuation of the travel alarm switch 48 transmits a signal 25 to a selector valve 50, which shifts the valve 50 to bring lines e and f into communication with the actuating valve 40. With the selector valve 50 in this position, actuating valve 40 is in communication with control valve 32, and in response to shifting valve 40, pressurized fluid is delivered from pump 24 via control valve 32 to the work element 16. Since the pump 12 is supplying the work element 14, it cannot simultaneously supply the work element 16. However, in response to the signal which is generated by the travel alarm switch 48, the pump 24 can supply the work element 16 via selector valve 50 and control valve 32, but the selector valve 50 is actuated only in response to receiving the signal from the travel alarm switch, which indicates that the work element 14 is actuated.

INDUSTRIAL APPLICABILITY

The subject fluid control system 10 is particularly useful for controlling operation of various work elements 14,16,28 of an excavator-type machine, such as a tree harvester. It should be understood, however, that the system can be utilized on other machines without departing from this invention. In the preferred example, the pump 12 supplies pressurized fluid to a track motor 14 via the control valve 20. The track motor 14 propels the machine in a preselected direction determined by the position of the control valve 20. Actuation of the control valve 20 is assisted by the pilot actuating system 36, including the actuating valve 42.

Simultaneous actuation of the track motor 14 and the swing motor 16 solely by the pump 12 is not possible since the track motor 14 has priority. However, simultaneous operation of the swing motor 16 is desirable and advantageous in order to position the upper portion of the machine during travel of the machine. To accomplish this function, swing motor 16 is activated via control valve 32, actuator valve 40, and selector valve 50. A signal 25 is generated by the travel alarm switch 48 in response to activation of the track motor 14 and is transmitted to the selector valve 50 to shift the valve 50 and position lines e and f in communication with the control valve 32. Shifting of the actuating valve 40 actuates the control valve 32 and supplies fluid power to the swing motor 16.

With the system of this invention, it is also possible to provide simultaneous power to the track motor 14, the swing motor 16, and the work element 28. To accomplish this, the actuating valve 44 is shifted which in turn shifts the control valve 30 to provide the work element 28 with pressurized fluid from the pump 24. Under these conditions, the flow control valve 34 limits the maximum volume of fluid available to the work element 28.

Other aspects, objects and advantages of this invention can be obtained from a study of the drawing, the disclosure, and the appended claims.

We claim:

1. A fluid control system (10) comprising:

first and second sources of pressurized fluid (12,24);

first, second, and third work elements (14,16,28);

first control means (18) for selectively controllably delivering pressurized fluid from said first source (12) to each of said first and second work elements (14,16);

first signal means (23) for transmitting a signal (25) only in response to pressurized fluid being delivered to the first work element (14), said first signal means (23) including a pressure swtch (48) in fluid communication with said first work element (14) and actuated in response to pressurized fluid being supplied to said first work element (14), and a selector valve (50) connected to said pressure switch (48) and activated by said signal (25); and second control means (26) for selectively controllably delivering pressurized fluid from said second source (24) to the third work element (28) and to the second work element (16) only in response to receiving said signal (25).

2. The improvement, as set forth in claim 1, including a pilot actuating system (36) having a third source of fluid pressure (38) an a plurality of actuating valves (40,42,44), said third source of fluid pressure (38) being controllably selectively deliverable to said first and second control means (18,26) by said actuating valves (40,42,44).

3. The improvement, as set forth in claim 1, wherein said second control means (26) includes a flow control valve (34) and limits the maximum amount of pressurized fluid delivered from said second source (24) to said third work element (28).

4. The improvement, as set forth in claim 1, wherein a controlled portion of the total amount of said pressurized fluid from said second source (24) is simultaneously deliverable to said second and third work elements (16,28).

5. A fluid control system (10) comprising:

first, second, and third sources of pressurized fluid (12,24,38);

first, second, and third work elements (14,16,28);

first and second control valves (20,22) for selectively controllably delivering pressurized fluid from said first source (12) to one of said first and second work elements (14,16);

first signal means (23) having a pressure actuated switch (48) in fluid communication with said first work element (14) and actuated in response to pressurized fluid being supplied to said first work element (14) for transmitting a signal (25) only in response to pressurized fluid being delivered to the first work element (14), and a selector valve (50) connected to said pressure switch (48) and actuated by said signal (25);

third and fourth control valves (30,32) for selectively controllably delivering pressurized fluid from said second source (24) to the third work element (28) and to the second work element (16) only in response to receiving said signal (25); and pilot actuating means (36) having a plurality of actuating valves (40,42,44), said third source of pressurized fluid (38) being controllably selectively deliverable to said first, second, third, and fourth control valves (20,22,30,32) by said actuating valves (40,42,44).

* * * * *